United States Patent [19]

Shurtleff

[11] B 3,981,242

[45] Sept. 21, 1976

[54] INFRASTAR CANNISTER CARTRIDGE

[75] Inventor: Edgar M. Shurtleff, Downey, Calif.

[73] Assignee: The United States of America as represented by the Secretary of the Army, Washington, D.C.

[22] Filed: Feb. 15, 1974

[21] Appl. No.: 443,163

[44] Published under the second Trial Voluntary Protest Program on February 3, 1976 as document No. B 443,163.

[52] U.S. Cl. ..... 102/42 R; 102/67; 102/92.4

[51] Int. Cl.[2] ..... F42B 7/04; F42B 13/18; F42B 13/48

[58] Field of Search ..... 102/42 R, 42 C, 67, 102/69, 92.4; 149/35

[56] References Cited

UNITED STATES PATENTS

| | | | |
|---|---|---|---|
| 1,203,649 | 11/1916 | Papuga | 102/42 C |
| 1,292,374 | 1/1919 | Richardson | 102/67 |
| 2,343,818 | 3/1944 | Sweeley | 102/42 R |
| 2,767,656 | 10/1956 | Zeamer | 102/42 R |
| 3,074,344 | 1/1963 | Devaux | 102/42 C |
| 3,320,882 | 5/1967 | Schulz | 149/35 |
| 3,724,378 | 4/1973 | Knight et al. | 102/42 C |

*Primary Examiner*—Charles T. Jordan
*Attorney, Agent, or Firm*—Nathan Edel;berg; A. Victor Erkkila; Max Yarmovsky

[57] ABSTRACT

Internally fragmented shot is stage released from a cartridge so as to yield a double cone-pattern of shot. The cartridge utilizes a two step fragment release design which expels fragments at two separate points on the projectile trajectory. Parasitic initiation of separate delay trains cause expulsion of fragmented shot so that fragment patterns achieved by each group of fragments yield a dense fragment pattern from point of release over a wider angle. Higher cartridge lethality is attained because an initial fragment pattern overlaps and includes a second fragment pattern. Ability of the design to initiate release of fragments at alternate positions in the projectile's trajectory results in an extended range "shot" capability.

3 Claims, 3 Drawing Figures

INFRASTAR CANNISTER CARTRIDGE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to increase the lethality and range of a cartridge. These prior art devices have generally utilized scored projectile warheads which were fragmentized by an explosion initiated by a delay train a fixed interval of time after expulsion of the projectile or round from the gun muzzle. One of the problems encountered with these prior art devices has been that aerodynamic drag on the fragments has limited their ability to travel a significant distance and still maintain a velocity which is lethal. Another problem with the prior art devices has been the wide dispersal angle of the fragmented shot and their limited probability of a direct hit on an aimed-at target.

The present invention overcomes these problems by permitting a dense cloud of fragments to be sequentially ejected in specific zones along the flight path of the projectile, thus achieving an extended range shot capability.

SUMMARY OF THE INVENTION

The present invention relates to an internally-fragmenting stage released cartridge having increased lethality at an extended range. The internally fragmenting stage released cartridge, hereinafter called INFRASTAR, comprises a plurality of assemblies of interlocking segmented steel fragments operatively positioned intermediate retainer plates for each assembly of fragments, a central tube to hold a first fragment assembly together and also to serve as a housing for a delay-explosive column that releases each group assembly of fragments at the proper time. A drive bushing attached to a second fragment assembly engages the rifling of a launching weapon and imparts spin to the round assembly. An ogive is fixedly attached to the front end of the round to reduce wind resistance. A cartridge case is used to hold an impact primer, propellant mixture and round assembly.

When the cartridge is fired by impact of a firing pin on the primer, the propellant charge is initiated producing high temperature gases which ejects the projectile or round from the cartridge case and at the same time parasitically ignites a delay train. The propellant gases force the round through the gun's rifling imparting spin to the round. Sufficient delay time is provided for the projectile to clear the gun muzzle before a first delay initiates a small first fragment release charge which severs the central tube and thereby releases a first assembly of fragments. The fragment dispersal is not caused by the small explosive force of the release charge, but rather by the centrifugal force imparted by the spin of the projectile. Fragments are scattered within a cone having an included central angle proportional to the ratio between the forward velocity and tangential velocity of the fragments themselves. The use of a small explosive charge to initiate fragment release increases the handling safety of the cartridge.

As the forward portion of the projectile continues along its trajectory the delay train continues to burn and initiates, after a predetermined period of time, a second small explosive charge which, in turn, releases a second assembly of fragments in the same manner as aforedescribed. The present design as illustrated shows a two-stage projectile, but greater numbers of fragment packs or assemblies may be used to improve the rounds lethality or effectiveness against a particular type of target.

One of the objects of the present invention is to provide an INFRASTAR cartridge having fragments which have a higher velocity at target impact.

Another object of the present invention is to provide an INFRASTAR cartridge for controlling the distance from the gun muzzle at which successive groups of fragments are released so that a higher measure of fragment effectiveness against a target can be achieved.

Another object of the present invention is to provide an INFRASTAR cartridge whose round is effective against a target over an extended range.

Another object of the present invention is to provide an INFRASTAR cartridge whose fragment dispersing charge is small so that the cartridge can be safely handled.

Another object of the present invention is to provide an INFRASTAR cartridge having improved operational performance over conventional shot type ammunition by having a double cone impact pattern instead of a single cone of shot.

Another object of the present invention is to provide an INFRASTAR cartridge having a first cone of shot which can be released at the weapon muzzle or at any other desired point in the projectile's trajectory.

Another object of the present invention is to provide an INFRASTAR cartridge having a second cone of shot which can be released a fixed time after the first cone is released.

A further object of the present invention is to provide an INFRASTAR cartridge whose fragment pattern yields a dense fragment pattern from the point of release over a wide angle.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawing.

DESCRIPTION OF THE PREFERRED EMBODIMENTS

Figure 1:
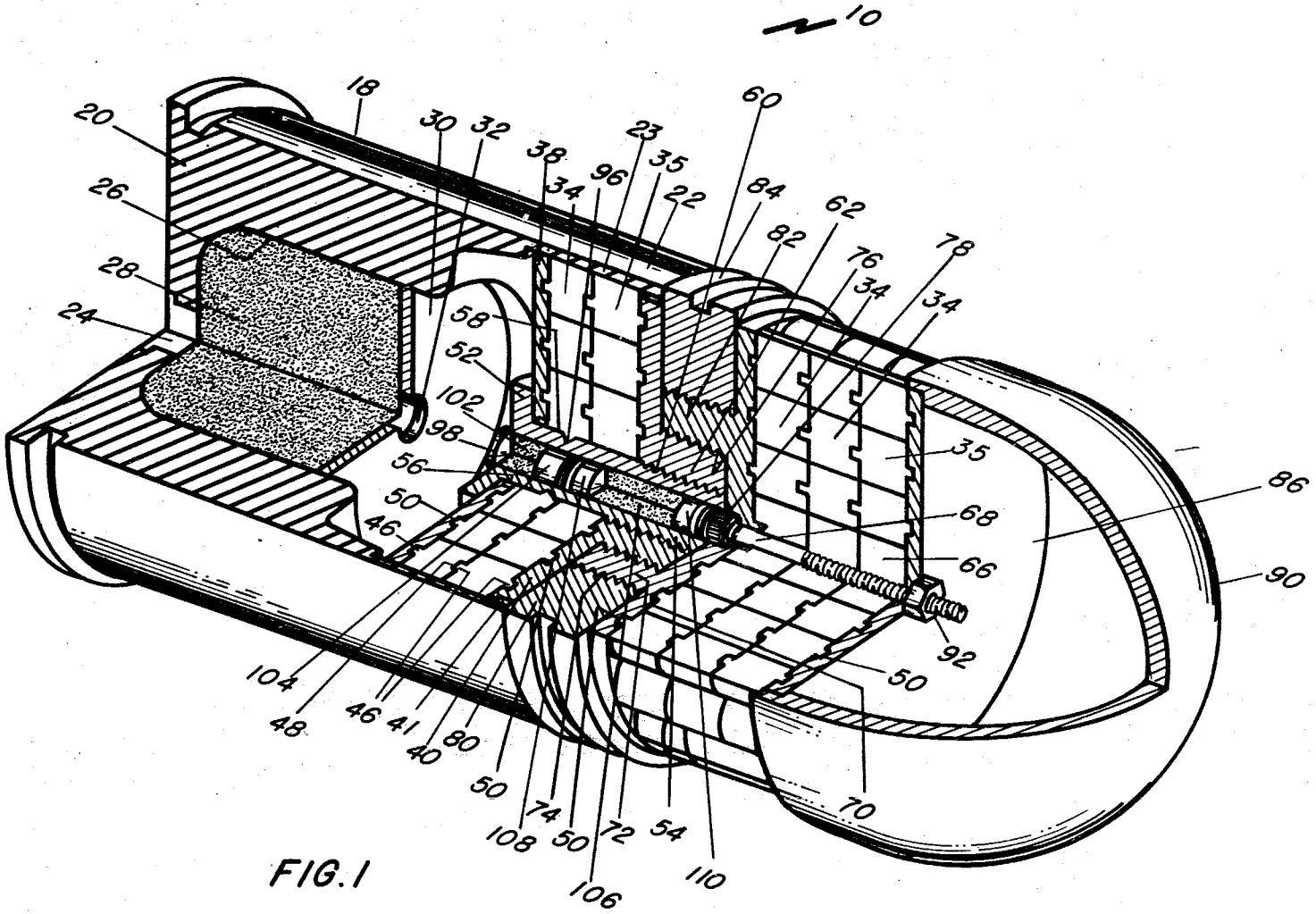
FIG. 1 is a partial longitudinal cross-sectional isometric view of the assembled INFRASTAR cartridge.
Figure 2:
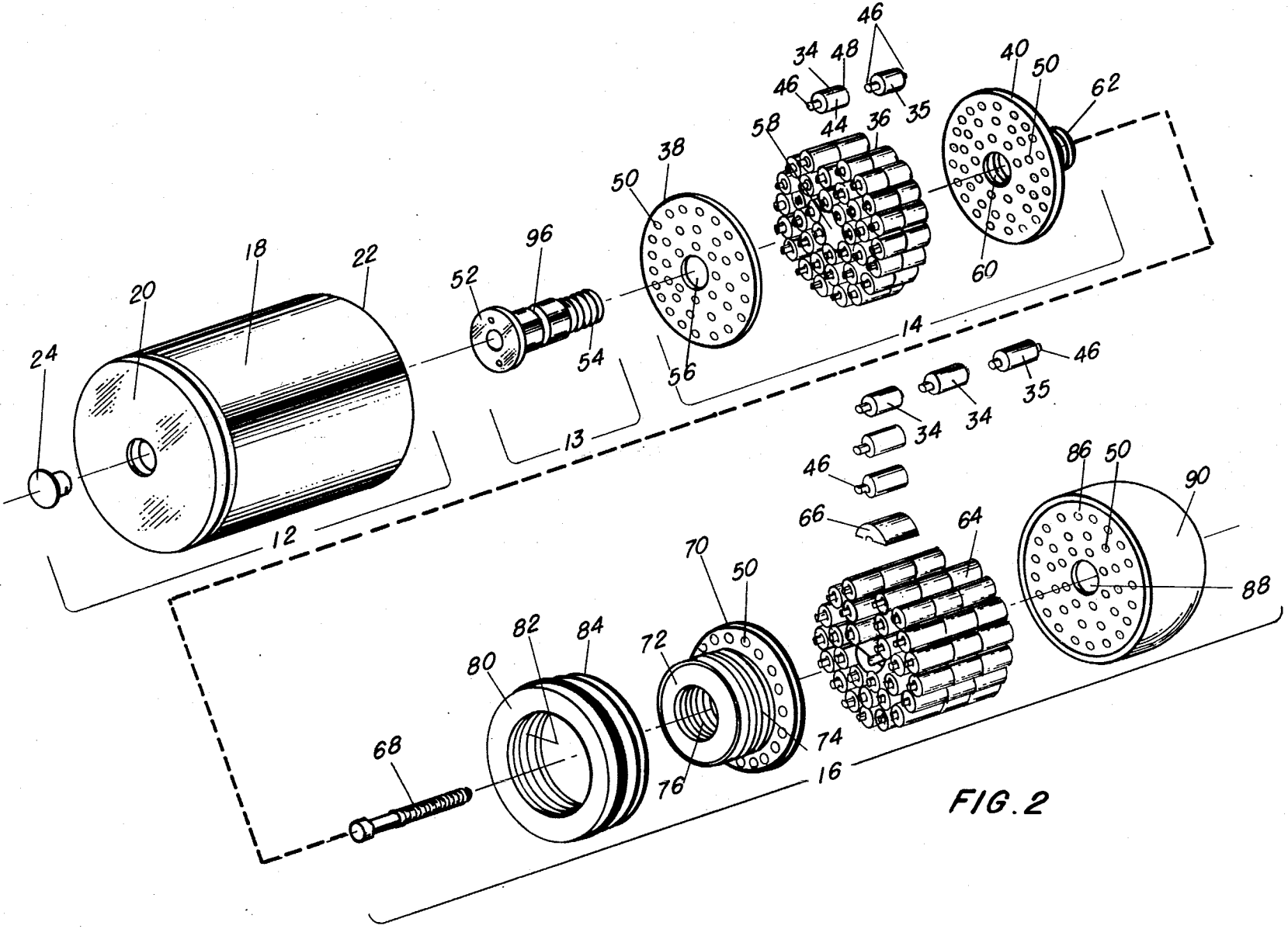
FIG. 2 is an exploded isometric view of the INFRASTAR cartridge.

Referring now to FIGS. 1 and 2, INFRASTAR cartridge 10 has four major assemblies (FIG. 2) which consists of a propellant assembly 12, a delay assembly 13, a first fragment assembly 14 and a second fragment assembly 16. Propellant assembly 12 comprises a cup-shaped cartridge case 18 having a partially closed rear end 20 and a forward open end 22. An impact primer sub-assembly 24 is operatively axially positioned in cartridge rear end 20. Cartridge case 18 has a central cup-shaped bore 26 which is partially filled with a propellant charge 28. Propellant charge 28 is retained within central bore 26 by a cardboard disc 30 which has an axial hole 32 therein. Forward end 22 of the cartridge case 18 operatively holds first fragment assembly 14 therein so that cardboard disc 30 is intermediate propellant charge 28 and the delay assembly 13 and first fragment assembly 14. First fragment assembly 14 comprises a plurality of radial tiers of interlocking cylindrically shaped fragments 34 and 35 spacially arranged in a two tier fragment annular sub-assembly 36. Fragment sub-assembly 36 is held together by a first retainer plate member 38, a second retainer plate member 40, and delay sub-assembly 13. Fragments 35 have a "rolling pin" configuration, that is, each end of cylindrical fragment body 44 has a cylindrical protrusion 46 on each end. Fragments 34 have a similar protrusion 46 on one end and a counter bore 48 on its opposite end which interlocks with one of the protrusions 46 of fragment 35. Fragments 34 and 35 after interlocking with each other are held intermediate plate retaining members 38 and 40 by the other protrusion 46 fitting into protrusion line up plate bores 50 located in each of the first and second plate members 38 and 40. First and second plate members 38 and 40 respectively are held together by delay assembly 13. Delay assembly 13 has a flange 52 which abuts against first plate member 38 and a threaded end 54 which passes through a central clearance hole 56 in plate member 40 through annular space 58 of the two-tier fragment sub-assembly 36 into a centrally threaded hole 60 of a threaded boss 62 on second plate member 40. Second fragment assembly 16 has a three tier annular fragment sub-assembly 64 having similar interlocking cylindrically shaped fragments 34 and 35 as previously described for the first fragment assembly 14. In addition sub-assembly 64 has three pairs of split fragments 66 which act as a bushing about the shaft of a screw 68. Fragment sub-assembly 64 is held intermediate a third retainer plate member 70 and a fourth retainer plate member 86. In a similar manner as aforedescribed for the first and second plate members 38 and 40, respectively, third and fourth plate members 70 and 86 have protrusion line-up plate bores 50 therein to hold protrusions 46. Third retainer plate member 70 has an axial boss 72 which has an externally-threaded portion 74 thereon, an internal axially-threaded bore 76, and an axially-positioned screw bore 78 therein. The fourth retainer plate member 86 has an axial clearance bore 88 therein which allows the passage therethrough of the screw 68. An ogive or windshield 90 is fixedly attached to the peripheral edge of fourth plate member 86. An annular drive bushing 80 has an internally-threaded bore 82 and a circumferentially-positioned rifling ring 84. Drive bushing 80 is screwed to threaded boss 72 of the third retainer plate member 70. The second fragment assembly 16 is held together by screw 68 and nut 92, the latter being threaded on screw 68 after it passes through the fourth plate member 86. First fragment assembly 14 is fixedly attached to second fragment assembly 16 by threaded boss 62 threadedly engaging internal threaded bore 76 of third retainer plate member 70. The complete round, which consists of assemblies 13, 14 and 16, is held by cartridge case wall 23. Cartridge case open forward end 22 is staked against peripheral edge 41 of second retainer plate member 40 thereby preventing the round from sliding out of cartridge case open end 22 prior to initiation of propellant charge 28.

Figure 3:
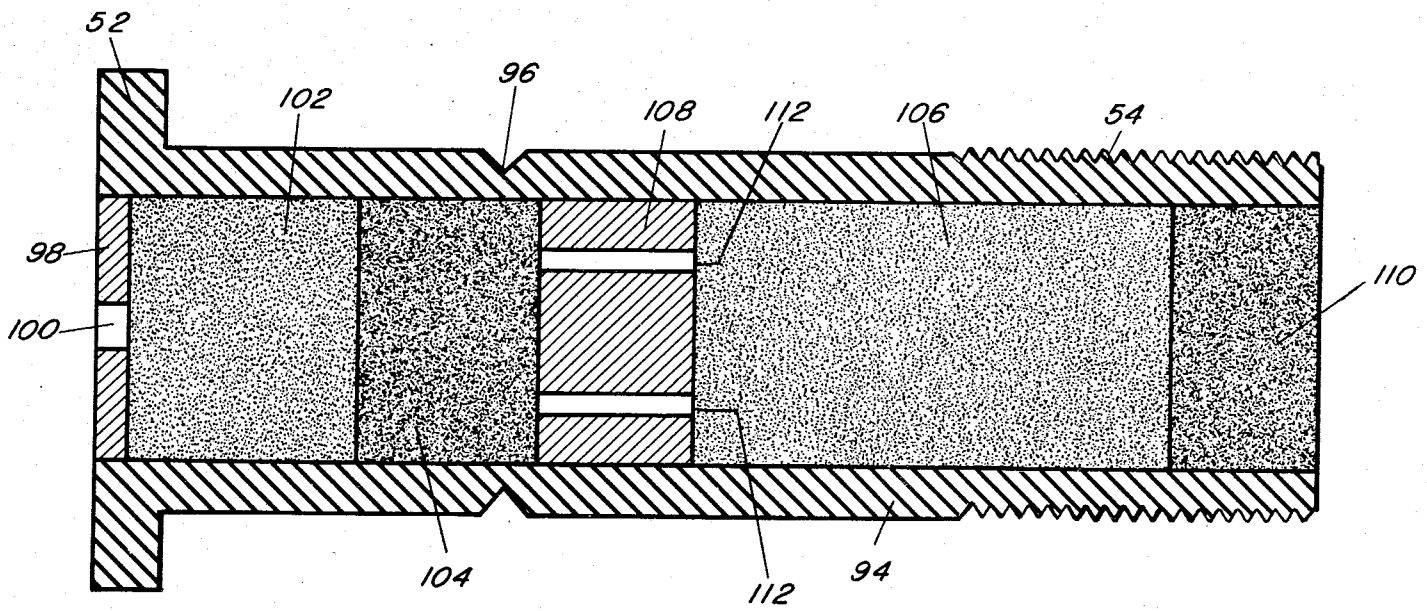
FIG. 3 is a longitudinal cross section view of the delay sub-assembly of FIG. 1.

FIG. 3 shows a longitudinal cross-sectional view of the delay assembly 13. Delay assembly 13 comprises a tubular member 94 which, as previously stated has a flange 52 on one end and a threaded end 54. Tubular member 94 has its wall necked down at point 96 intermediate the flange 52 and the threaded end 54. Staked in the flanged end 52 is a lead washer 98 having an axial hole 100 therein. Adjacent lead washer 98 is a delay charge 102, which may be a mixture of 65 parts of zirconium, 25 parts of iron oxide and 10 parts of lead azide, and adjacent to first delay charge 102 is a first detonator or severing charge 104 which is operatively positioned opposite the necked-down wall section 96. Adjacent to first detonator charge 104, and intermediate the first detonator charge 104 and a second delay charge 106, is a disc-shaped aluminum baffle member 108. A pair of longitudinal flash bores 112 pass through baffle member 108. The delay charges 102 and 106 may be made of the same material aforedescribed. A second detonator charge 110 is operatively positioned in the threaded end 54 so that it is adjacent the second delay charge 106. The first and second detonator charges 104 and 110, respectively, may be made of such material as lead azide.

In operation, when INFRASTAR cartridge 10 is fired, first delay charge 102 is parasitically ignited through axial hole 100 in the fashion of a tracer round. Sufficient delay is provided for the projectile, which consists of the first and second fragment assemblies 14 and 16, to clear the gun muzzle before the first delay charge 102, in turn, initiates the first fragment release detonator charge 104, severing tubular member 94 at necked-down wall section 96, thereby releasing the two-tier first fragment sub-assembly 36 so that the individual fragments 34 and 35 thereof may be dispersed by the combined forces of spin and lateral acceleration. As the forward portion of the projectile, consisting of the second fragment assembly 16, continues along its trajectory, the remaining section of the delay assembly to the right of section 96 is initiated. Second delay charge 106 is initiated through the aluminum baffle member 108. The second delay charge 106 continues to burn until such time as it ignites the second detonator charge 110. The second detonator charge 110 upon initiation causes release of the fragments 34, 35 and 66 of the three-tier annular fragment sub-assembly 64 in the same manner as aforedescribed for the two-tier fragment annular sub-assembly ring 36.

The present design as illustrated by FIGS. 1 and 2 involves a two-stage projectile, but it should be clearly understood that a greater number of fragment packs or assemblies may be used.

The foregoing disclosure and drawings are merely illustrative of the principles of this invention and are not to be interpreted in a limiting sense. I wish it to be undetstood that I do not desire to be limited to the exact details of construction shown and described for obvious modifications will occur to a person skilled in the art.

Having thus fully described this invention, What is claimed as new and desired to be secured by letters patent of the United States is:

1. An internally fragmenting stage released cartridge which comprises:

a cup shaped cartridge case having a partialy closed end and an open end;

a primer fixedly axially positioned in said closed end;

propellant means operatively positioned within said cartridge case adjacent said primer for generating gas pressure within said cartridge case upon initiation by said primer;

first fragment means operatively disposed in the open end of said cartridge case and means for holding said first fragment means together during a first interval of time and for releasing said first fragment means after said first interval of time which includes;

a disc shaped first retainer plate member having a plurality of operatively disposed protrusion line-up bores and an axial clearance hole therein;

a plurality of interlocking cylindrically shaped fragments operatively arranged in a two-tier annular fragment assembly, said two-tier assembly having protrusions on a first end which slidably engage said line-up bores in said first retainer plate member; and a disc shaped second retainer plate member having a plurality of operatively disposed protrusion line-up bores therein, and a central threaded hole therein, said annular fragments assembly also having protrusions on its second end which slidably engage said line-up bores in said second retainer plate member;

second fragment means attached to said first fragment means and means for holding said second fragment means together during said first interval of time and for releasing said second fragment means after a second interval of time; and means for releasing said first fragment means comprising delay means axially positioned within said first fragment means operatively disposed adjacent said means for releasing said second fragment means for sequentially initiating the release of said first and second fragment means so that a double cone pattern of shot is generated by firing of said cartridge;

wherein said delay means passes through said axial clearance hole and said fragment assembly to threadedly engage the central threaded hole of said second retainer plate member.

2. A cartridge as recited in claim 1 wherein said second fragment means comprises:

an annularly shaped drive bushing having a rifling ring on its peripheral edge, an axially positioned internally threaded bore and an axially positioned screw bore therein;

a retainer plate member having an axial externally threaded boss on a first side, said boss having an internally threaded bore therein, said drive bushing threadedly attached to the axial boss of said retainer plate member, said retainer plate member having a plurality of protrusion line-up bores therein;

a plurality of interlocking cylindrically shaped fragments operatively arranged in a three-tier annular fragment assembly, said three-tier assembly having protrusions on a first and second end, said protrusion on said first end slidably engages the protrusion line-up bores of said retainer plate member;

a disc shaped plate member having an axial clearance bore therein, said disc having a plurality of operatively disposed protrusion line-up bores, said line-up bores slidably engage the second end protrusions of said three-tier annular fragment;

an ogive fixedly attached to the peripheral edge of said disc shaped plate member;

a screw partially passing through said retainer plate member, said three-tier fragment assembly, and said disc plate member which operatively holds said second fragment means together.

3. A cartridge as recited in claim 1 wherein said delay means comprises:

a tubular member having a flanged end, a threaded end, and a necked-down wall section;

a lead washer fixedly attached to the flanged end of said tubular member, said washer having an axial hole therein;

a first detonator charge operatively positioned within said tubular member adjacent said necked-down wall section;

a first delay charge proximately disposed within said tubular member intermediate said lead washer and said first detonator charge, said first delay charge being parasitically ignited by said propellant means through the axial hole in said lead washer, said first delay charge initiating said first detonator charge after a first interval of time;

a disc shaped baffle member operatively disposed within said tubular member immediately adjacent said first detonator charge, said baffle member having a pair of longitudinally disposed holes passing therethrough;

a second detonator charge proximately disposed within the threaded end of said tubular member; and a second delay charge proximately positioned intermediate said baffle member and said second detonator charge, said second delay charge being parasitically ignited by said first detonator charge, said second delay charge initiates said second detonator charge after a second interval of time.

* * * * *